United States Patent [19]

Finster et al.

[11] Patent Number: 4,589,521

[45] Date of Patent: May 20, 1986

[54] ADJUSTABLE IMPLEMENT HOLDER FOR STEPLADDERS

[76] Inventors: Emma R. Finster; Peter W. Finster, both of 217 Glasgow Street, Kitchener, Ontario, Canada, N2M, 2M3

[21] Appl. No.: 769,507

[22] Filed: Aug. 26, 1985

Related U.S. Application Data

[63] Continuation-in-part of Ser. No. 697,612, Feb. 4, 1985, Pat. No. 4,550,803.

[51] Int. Cl.[4] ..... E06C 7/14

[52] U.S. Cl. ..... 182/129; 248/238

[58] Field of Search ..... 182/129, 181–186, 182/224, 116; 248/210, 238

[56] References Cited

U.S. PATENT DOCUMENTS

| | | | |
|---|---|---|---|
| 2,442,477 | 6/1948 | Wallace | 335/29 |
| 2,990,764 | 7/1961 | Wilder | 182/129 |
| 3,310,270 | 3/1967 | Ciancio | 248/210 |
| 3,442,477 | 5/1969 | Garrett | 182/129 |
| 3,979,097 | 9/1976 | Baine | 182/129 |
| 3,987,993 | 10/1976 | Hopkins | 248/210 |
| 3,998,416 | 12/1976 | Benolkin | 248/210 |
| 4,036,463 | 7/1977 | Hopkins | 248/210 |
| 4,077,595 | 3/1978 | Carter | 248/210 |
| 4,222,541 | 9/1980 | Cillis | 248/210 |
| 4,418,793 | 12/1983 | Brent | 182/129 |
| 4,424,949 | 1/1984 | Kimmett | 248/238 |
| 4,550,803 | 11/1985 | Finster | 182/129 |

*Primary Examiner*—Reinaldo P. Machado
*Attorney, Agent, or Firm*—Henderson & Sturm

[57] ABSTRACT

The present invention comprises an apparatus (10) for adjustably supporting diverse articles (16) on a stepladder (17). The apparatus includes in general an article securing means (15) releasably supported in a support unit (12), which is mounted for relative rotation with respect to a base unit (11). In addition, a releasable locking means (14) operatively controls the relative rotation between the support unit (12) and the base unit (11), and mounting bracket units (13) and (80) are also provided to securely engage the base unit (11) on the stepladder (17), either directly or indirectly.

3 Claims, 11 Drawing Figures

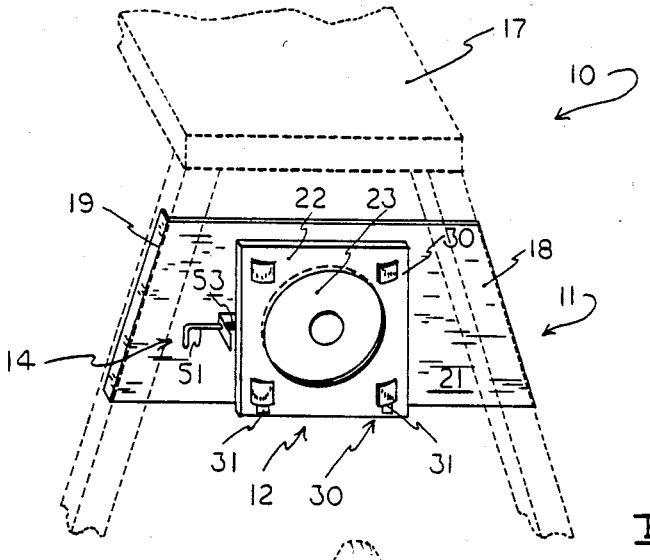
Fig 1
Fig 2
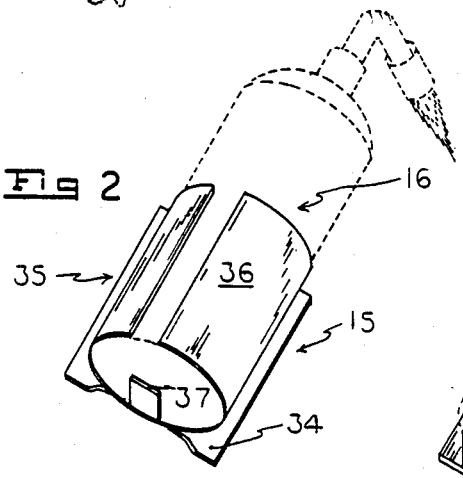
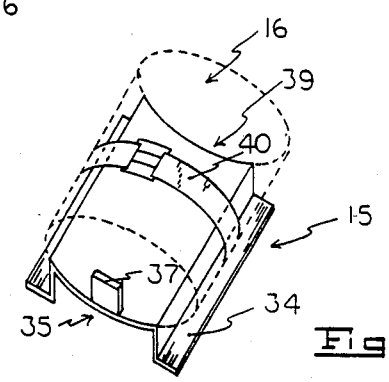
Fig 3
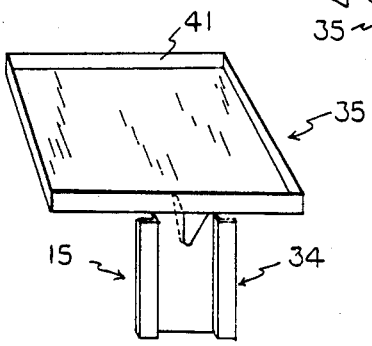
Fig 4

ADJUSTABLE IMPLEMENT HOLDER FOR STEPLADDERS

BACKGROUND ART

This is a continuation in part of U.S. patent application Ser. No. 697,612 field Feb. 4, 1985, now U.S. Pat. No. 4,550,803.

TECHNICAL FIELD

The present invention relates generally to add-on implement support apparatus for use in conjunction with stepladders or the like.

The prior art is replete with patented apparatus whose sole purpose and function is to provide a stable support for a variety of implements normally used in conjunction with a stepladder, as can be seen by reference to the following U.S. Pat. Nos. 3,979,097; 4,418,793; 3,422,477; and 4,424,949.

The vast majority of the prior art devices are designed to be releasably secured to a stepladder, and configured to provide a support surface that is specifically contoured to cooperate with a limited number at best of a variety of implements, that may reasonably be expected to be utilized in conjunction with a stepladder.

While most of the prior art devices are intended to be used with paint containers or the like, at least one prior art patent (e.g., J. C. Garrett, et al., U.S. Pat. No. 2,442,477) has recognized the need for support apparatus that is specifically adapted to accommodate a diverse implement.

While all of the prior art apparatus are adequate for their intended purpose and function, they are also deficient with respect to their ability to accommodate diverse implements, as well as their apparent total disregard for situations wherein a non-vertical orientation of the supported implement is either required or desired due to working conditions or the personal preference of the user.

Not until the development of the present invention has an adjustable orientation diverse implement supporting apparatus been available for use in conjunction with a stepladder. In addition, the present invention represents a vast advance in the state of the art over previously patented structure, and it is anticipated that the instant apparatus will receive both widespread consumer approval, as well as a significant degree of commercial success.

DISCLOSURE OF THE INVENTION

The apparatus of the present invention comprises in general a base unit, a support unit mounted for relative rotation with respect to the base unit, a mounting bracket unit, and an implement securing means operatively associated with the support unit.

The base unit comprises a trapezoidal member that is configured and adapted to be releasably secured to the angled exterior of a stepladder, when the stepladder is deployed in its fully extended disposition.

As mentioned supra, the support unit is mounted for relative rotation with respect to the base unit; and is further provided with a releasable locking means that can be actuated to constrain the relative movement between the support unit and the base unit at any desired orientation.

The implement securing means comprises a plurality of implement securing units that are adapted to receive and/or support one or more of a variety of implements, contemplated for normal usage in conjunction with a stepladder.

In addition, this invention also contemplates the use of a mounting plate unit operatively connected to the base unit and operatively associated with the stepladder to preclude the legs of the stepladder from assuming the retracted or folded-up position while the apparatus of this invention is in its operative disposition.

By virtue of the foregoing structural cooperation between the elements, the present invention provides an adjustable orientation diverse implement supporting apparatus that is unique, novel and versatile in its construction and operation.

BRIEF DESCRIPTION OF THE DRAWINGS

These and other objects, advantages and novel features of the present invention will become more clear upon a thorough study of the following description of the best mode for carrying out the invention, particularly when reviewed in conjunction with the drawings, wherein:

FIG. 1 is a perspective view of the base unit and the support unit operatively disposed on a stepladder;

FIGS. 2 through 4 are isolated perspective views of various securing units contemplated for use with the support unit;

BEST MODE FOR CARRYING OUT THE INVENTION

Figure 5:
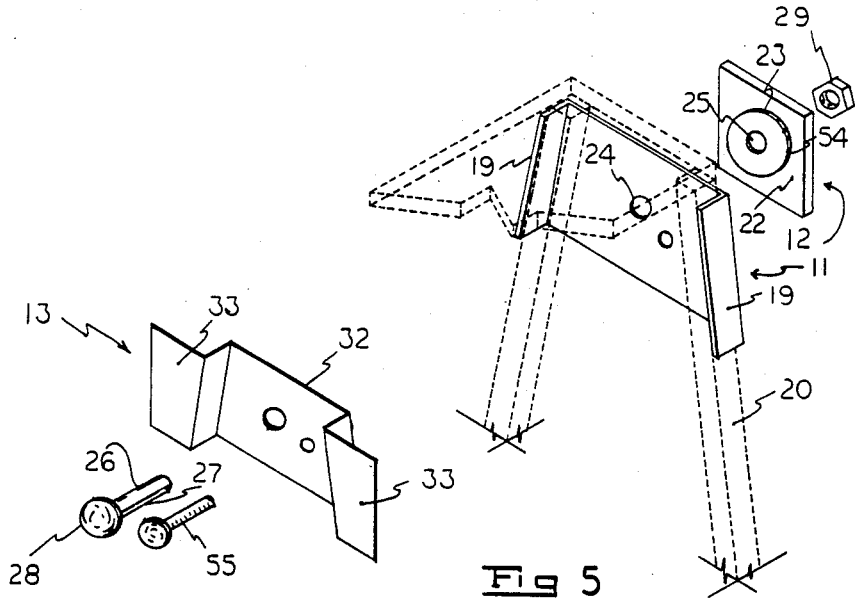
FIG. 5 is a perspective view illustrating the cooperation between the mounting plate unit, the stepladder, the base unit, and the support unit.
Figure 6:
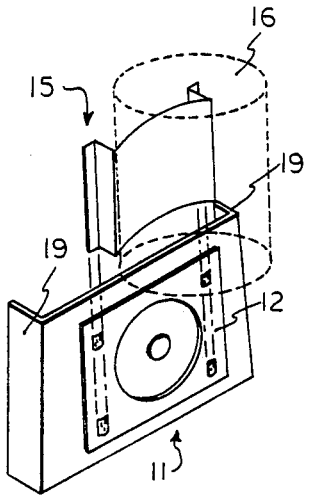
FIG. 6 is an exploded perspective view showing the cooperation between the support unit and one of the securing units.

Referring now to the drawings, the apparatus may be seen as depicted generally by the numeral 10. The apparatus (10) includes in general, a base unit (11), a support unit (12), a mounting bracket unit (13), a releasable locking means (14), and article securing means (15) adapted to operatively support different articles (16) on a stepladder (17). Each of these units will now be described in seriatim fashion.

The base unit (11) comprises a base member (18) having a generally trapezoidal configuration and whose outboard edges (19) are disposed generally perpendicular to the main body of the base unit (18). As can be seen in FIGS. 1 and 5, this arrangement allows the outboard edges (19) of the base unit (11) to frictionally engage the exterior surface of the stepladder legs (20).

The support unit (12) is rotatably disposed on the face (21) of the base member (18), and includes a generally rectangular support plate (22) having a centrally disposed circular recessed portion (23). The recessed portion (23) is further provided with a centrally disposed aperture (24) that is aligned with a complementary aperture (25) in the base member (18).

The aforementioned respective apertures (24) and (25) in the support unit (12) and the base unit (11) are dimensioned to receive an axle member (26) for rotatably securing the support unit (12) to the base unit (11). As shown in FIGS. 1 and 5, the axle member (26) comprises a bolt (27) having an enlarged head (28) and a threaded end that is adapted to cooperate with a nut (29) in a well recognized manner.

In addition, the support plate (22) is further provided with a plurality of outwardly projecting tang elements (30) that are dimensioned to slidingly receive the variety of article securing means (15), which will be described in detail further on in the specification. The tang elements (30) on the upper portion of the support plate (22) are generally L-shaped in configuration to allow the article securing means (15) to be inserted and removed from the support plate (22). However, the tang elements (30) on the lower portion of the support plate have a floor element (31) to provide a support surface for the article securing means (15) to rest upon.

The mounting bracket (13) is illustrated in FIG. 5, and comprises a bracket member (32) having outwardly projecting arms (33) that are adapted to frictionally engage the interior surface of the stepladder legs (20) when the bracket member (32) is attached to the base member (18) via suitable fastening means (55), such as bolts, screws, clamps, etc.

The different article securing means (15) are shown in detail in FIGS. 2 through 4, and comprise in general a flanged plate element (34) having an article support portion (35) formed thereon.

The first article securing means (15) contemplated for use in the apparatus (10), is illustrated in FIG. 2, and comprises a flanged plate element (34) whose article support portion (35) comprises a generally open cylindrical member (36) having an outwardly projecting floor element (37). The cylindrical member (36) is dimensioned to closely conform to the periphery of a cylindrical article (16), such as a propane torch, can of spray paint, or the like.

The second article securing means (15) is illustrated in FIG. 3 and comprises a flanged plate element (34), having an arcuate recess (39) formed therein, an article support portion (35) in the form of a floor element (37) extending outwardly from the lower portion of the arcuate recess (39); and, an adjustable securing strap arrangement (40) adapted to releasably secure cylindrical articles (16) of different circumferences to the article securing means (15) in a well recognized manner.

The third article securing means (15) is illustrated in FIG. 4, and comprises a flanged plate element (34), having an article support portion (35) in the form of a lipped tray member (41) secured to the top of the flanged plate element (34). The lipped tray member (41) is particularly well suited for supporting and retaining discrete rollable articles (not shown), such as nails or the like.

Figure 7:
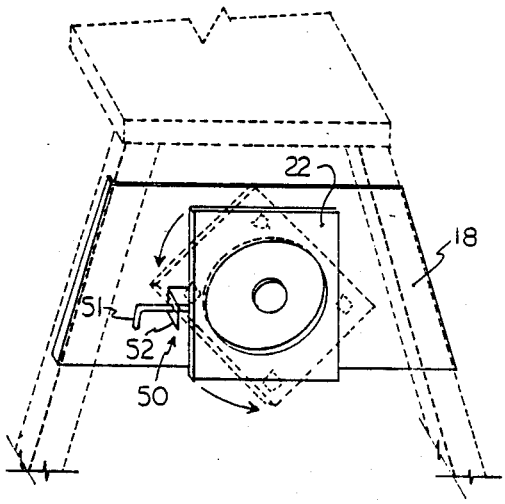
FIG. 7 is a perspective view illustrating the relative movement of the support unit with respect to the base unit and the stepladder.

The releasable locking means (14) of the preferred embodiment, is depicted in FIGS. 1 and 7, and comprises in general a locking member (50) movably mounted on the base member (18) and adapted to releasably engage and restrain the support plate (22) from relative rotation with respect to the base member (18).

In the embodiment illustrated, the locking member (50) comprises a lever arm (51) mounted in a lever bracket (52), wherein the inboard end of the lever arm is urged by a spring (53) into releasable engagement with complementary apertures (54) formed in the recessed portion (23) of the support plate (22). When the lever arm (51) is withdrawn from contact with the support plate (22), the support unit (12) is free to be angularly adjusted with respect to the base unit (11) to any position desired by the user.

It should be appreciated at this point that the fastening means (55) heretofore described is for purposes of illustration only, and any suitable fastening means may be substituted therefore to restrict the relative rotation of the base unit with respect to the support unit.

Figure 8:
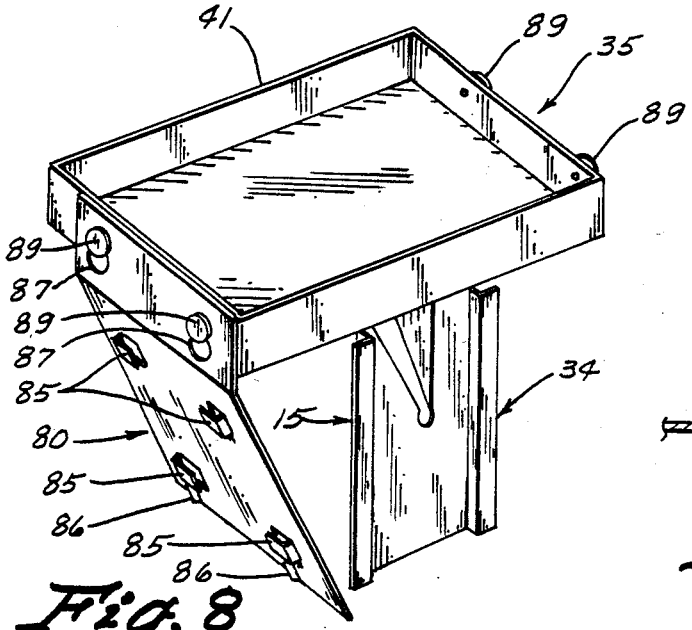
FIG. 8 is a perspective view of another embodiment of the present invention having a support bracket thereon.
Figure 11:
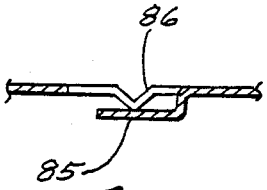
FIG. 11 is an enlarged partial cross-sectional view taken along line 11—11 of FIG. 9.
Figure 9:
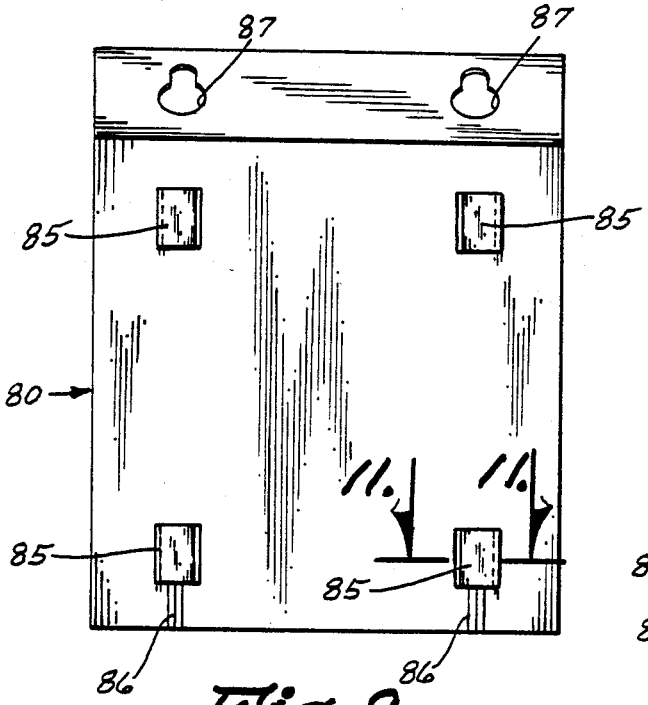
FIG. 9 is a front view of the support bracket of FIG. 8.
Figure 10:
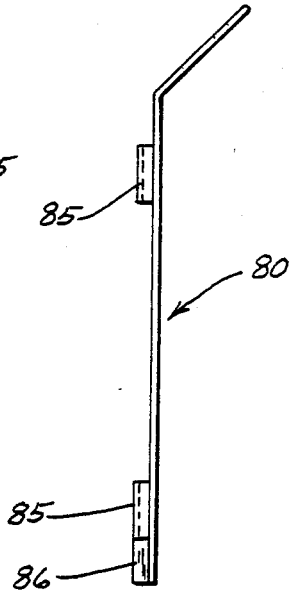
FIG. 10 is a side elevational view of the support bracket of FIG. 9.

As shown in FIGS. 8 through 10, two shoulder rivets (89) are attached to each side of the lipped tray member (41). A support unit (80) is similar to support unit (12) in FIG. 1, but is slightly longer and has two elongated holes (87) in the upper bent down 47° portion of the support unit (80). This support unit (80) will adapt to the two shoulder rivets (89) on the lipped tray member (41).

Tang elements (85) on the support unit (80) are generally L-shaped in configuration to allow the article securing means (15) to be inserted and removed from the support unit (80). However, the tang elements (85) on the lower portion of the support unit have a floor element (86) to provide a support surface for the article securing means (15) to rest upon.

This support unit (80) can be used in conjunction with the lipped tray member (41). This makes the complete unit (80) more versatile. As shown on the drawings FIGS. 1 to 7, only one attachment can be used at a time with an extra support unit (80) shown in FIGS. 9 and 10, two attachments can be used at one time on each side of tray member (41).

Having thereby described the subject matter of this invention, it should be obvious that many substitutions, modifications, and variations are possible in light of the above teachings. It is therefore to be understood that the invention as taught and described herein is only to be limited to the extent of the breadth and scope of the appended claims.

We claim:

1. An apparatus for adjustably supporting diverse articles on a stepladder wherein the apparatus comprises:

a base unit including a base member whose outboard edges are adapted to frictionally engage the exterior surface of the stepladder legs;

a support unit rotatably mounted on said base unit comprising:

a support plate having a plurality of tang elements projecting outwardly therefrom, wherein said plurality of tang elements are dimensioned to slidingly receive the said article securing means, at least one of said plurality of tang elements having a floor element that provides a support surface for said article securing means;

an article securing means releasably engaged by said support unit, and adapted to operatively support diverse articles; said article securing means includes:

a flanged plate element having an article support portion thereon, said article support portion including a lipped tray member secured to the top of said flanged plate element, the improvement comprising:

a releasable locking means operatively associated with said base unit, and said support unit for restricting the relative rotation between said base unit and said support unit;

a mounting bracket unit comprising a bracket member, having outwardly projecting arms that are adapted to frictionally engage the interior surface of the stepladder legs, when the bracket member is operatively connected to the base member via suitable fastening means;

support unit means for operably receivably attaching a second article securing means thereto; and means for removably attaching said support unit means to one side of said lipped tray member.

2. The apparatus of claim 1 including means on another side of said lipped tray member for selectively receivably holding said support unit means.

3. The apparatus of claim 1 wherein said attaching means comprises a pair of projections on one of the tray members and the support unit means and complementary openings for receiving said pair of projections on the other of said tray member and said support unit means.

* * * * *